United States Patent [19]

Fischer et al.

[11] Patent Number: 5,033,275

[45] Date of Patent: Jul. 23, 1991

[54] PROCESS FOR THE MANUFACTURE OF PILED GOODS AND WARP KNITTING MACHINE ADAPTED THEREFORE

[75] Inventors: Joachem Fischer, Rodgau; Gerhard Bergmann, Heusenstamm; Franz Graf, Rodgau, all of Fed. Rep. of Germany

[73] Assignee: Karl Mayer Textilmaschinenfabrik GmbH, Obertshausen, Fed. Rep. of Germany

[21] Appl. No.: 494,571

[22] Filed: Mar. 16, 1990

[30] Foreign Application Priority Data

Mar. 18, 1989 [DE] Fed. Rep. of Germany ..... 3909013

[51] Int. Cl.[5] ..... D04B 21/02

[52] U.S. Cl. ..... 66/84 R

[58] Field of Search ..... 66/84 R, 194

[56] References Cited

U.S. PATENT DOCUMENTS

| | | | |
|---|---|---|---|
| 3,168,821 | 2/1965 | Zwingenberger | 66/84 R |
| 3,834,193 | 9/1974 | Wilkens | 66/84 R X |
| 4,297,858 | 11/1981 | Blasberg et al. | 66/194 |
| 4,397,160 | 8/1983 | Winter et al. | 66/120 |

FOREIGN PATENT DOCUMENTS

| | | | |
|---|---|---|---|
| 2117580 | 10/1972 | Fed. Rep. of Germany | 66/194 |
| 2843264 | 10/1977 | Fed. Rep. of Germany . | |
| 2263575 | 9/1978 | Fed. Rep. of Germany . | |
| 2543714 | 4/1980 | Fed. Rep. of Germany . | |
| 61-58580 | 12/1986 | Japan | 66/194 |

*Primary Examiner*—Werner H. Schroeder
*Assistant Examiner*—John J. Calvert
*Attorney, Agent, or Firm*—Omri M. Behr

[57] ABSTRACT

A process for the preparation of pile ware on a warp knitting machine wherein, the formation of pile on the front and rear of the goods is respectively achieved by a pile thread system. For the formation of a pile free allocation the threads of at least one pile thread system can in accordance with the pattern, be so individually controlled that upon a signal they can be laid about a first or a second needle. This may be achieved by means of a jacquard bar whose needles are individually steerable in accordance with the demands of the pattern by a jacquard arrangement. In this manner it is possible to obtain a desired patterning using a pile thread system.

9 Claims, 5 Drawing Sheets

PROCESS FOR THE MANUFACTURE OF PILED GOODS AND WARP KNITTING MACHINE ADAPTED THEREFORE

BACKGROUND OF THE INVENTION

The invention is directed to a process of manufacturing pile wares on a warp knitting machine wherein, the ground ware is produced by at least one thread system being laid about a first needles with which a stitch formation results and the formation of the pile on the forward and rearward side of the goods is provided by a forward and rearward pile thread system whose threads are alternately laid over first needles and, at least two work cycles later around second needles not involved in the formation of the ground ware, from which the loops are knocked over. A warp knitting machine adapted for practicing such a process is also disclosed.

A process of this general type, as well as a machine adapted therefore, are disclosed in German Patents 22 63 575 and 28 43 264. Two guide bars are utilized for the formation of the ground ware, one of which lays the chain stitch and the other a partial weft thread. The threads are laid over a set of first needles which are separated from each other by a second needle. The forward and rearward pile thread guide bar lays the pile threads alternately about a first needle where they become stitched in with the ground ware and then around a second needle from which, in the next working cycle it is knocked over as a loop. By this means there is provided, ground ware having pile loops on both sides.

The difference between these two disclosures is that the first and the second needles which lie on a common needle bar, are each served by a different guide bar. The guide bar which services the second needles can go through a longer path than the bar for the first needles. This permits the formation of larger pile loops. Neither of this disclosures mentioned the possibility of individual guide control by, for example, a Jacquard mechanism.

It is further known from German patent 25 43 714, how to provide a pile free cross strip running across the width of the goods. To achieve this end one of the two pile thread guide bars executes a lapping motion which is displaced by at least one needle space. This has the results that the second needles are alternately lapped by the forward and rearward pile thread systems and thus result in the formation of a stitch.

U.S. Pat. No. 4,397,160 to Applicant's assignee,,discloses in FIGS. 2 and 4 thereof, the use of full head needles to produce larger pile loops. This disclosure also does not mention the possibility of individual, i.e., Jacquard control of the guides.

SUMMARY OF THE INVENTION

The object of the present invention is to provide a process of the foregoing type which enables desired patterning such as script or ornamental patterns to be produced either on one side or on both sides of the goods by the provision of pile containing or pile free areas. This object is attained by the formation of pile free areas in which the threads of at least one pile thread system are individually controllable so that, as desired, they can be laid over a first or a second needle. In this manner the pile formation can be suppressed, in accordance with location and pattern. Thus, script, ornaments, or other patterning may be provided either as a positive or a negative pattern.

In one mode of operation, in accordance with the requirements of the pattern, the pile threads are individually alternately laid about two first needles. Since these pile threads are stitched into the ground ware in every working cycle, pile free areas are produced on the corresponding side of the goods on which the jacquard controlled pile threads are laid. On the opposite side it is possible to provide either an even pile surface of a different pattern.

In another embodiment, in accordance with the desired pattern, the pile threads are individually, alternately laid about two second needles in such a manner that the threads of the forward and rearward pile thread system are alternately laid about said second needles. Since said second needles are lapped by the pile threads in each working cycle there is a continuous formation of a stitch so that the pattern is provided by the same pile free areas on both sides of the goods.

Goods produced in this manner can be distinguished from jacquard produced woven goods such as toweling in which the pattern appears positively on one side and negatively on the other side.

It is particularly desirable to provide that only the threads of the forward pile thread system are individually steerable for pattern provision. This is sufficient to provide both a pattern on the front side and a pattern on both sides.

It is also desirable to provide that the lapping of threads of the forward pile thread system is arranged so that the thread consumption of the pile free and pile covered areas is substantially the same. The takeoff speed of the pile threads thus remains substantially constant which in turn gives rise to an even pile. This is achieved by providing that the underlap of the pile threads on the pile free zones is larger than the underlaps of the pile in the pile covered areas.

A warp knitting machine for carrying out this procedure comprises a needle bar having a first and second needle, at least one ground ware guide bar, a forward and a rearward pile thread guide bar and a guide bar control arrangement for the provision of a base lapping motion which further comprises the provision of at least one of the pile thread guide bars as a jacquard bar whose guides are individually controllable for pattern formation by a jacquard control arrangement and are so displaceable that during the formation of an unchanged base lapping motion of the jacquard bar the original pile thread is, by choice, lapable either over the first or the second needle.

The individual control of the guides for pattern formation can thus be readily carried out since jacquard controlled guide bars are standard equipment in warp knitting machines. Furthermore, if a jacquard bar is provided to the forward as well as the rearward pile thread system, the patterning can be applied in a different manner on each side.

Generally speaking, however, it is sufficient to provide only the forward pile thread guide bar as a jacquard bar. This is so because even with one guide bar it is possible, as stated hereinabove, to provide patterning effects on the rear side of the goods as well. Furthermore, there is plenty of room in the machine to provide such a guide bar and the corresponding jacquard control arrangement on the front side.

It is particularly advantageous to provide the jacquard control arrangement for a base lap in which the corresponding pile threads are laid alternately about the first needles without displacement of the guides. In the base position of the guides there is produced a pile free upper surface of the goods. By displacement of the guides in each second work cycle, the pile loops are produced. By displacement of the guides in each working cycle, there is produced a pile free area on both sides.

There also exists the possibility to utilize the jacquard bar guide arrangement to produce a base lap, in which the appropriate pile threads are lapable about the first and the second needles without displacement of the guides. In this case, the displacement of the guides in each second working cycle leads to the suppression of pile formation on one side of the goods and the displacement of the guides in each cycle to the suppression of pile formation on both sides.

It is furthermore advantageous, that the second needle is a full head needle with a reduced catching capacity of its needle hook. Such full head needles provide substantially large pile loops.

The invention is illustrated with respect to its preferred embodiments in the drawings summarized below.

DETAILED DESCRIPTION OF THE DRAWINGS

Figure 1:
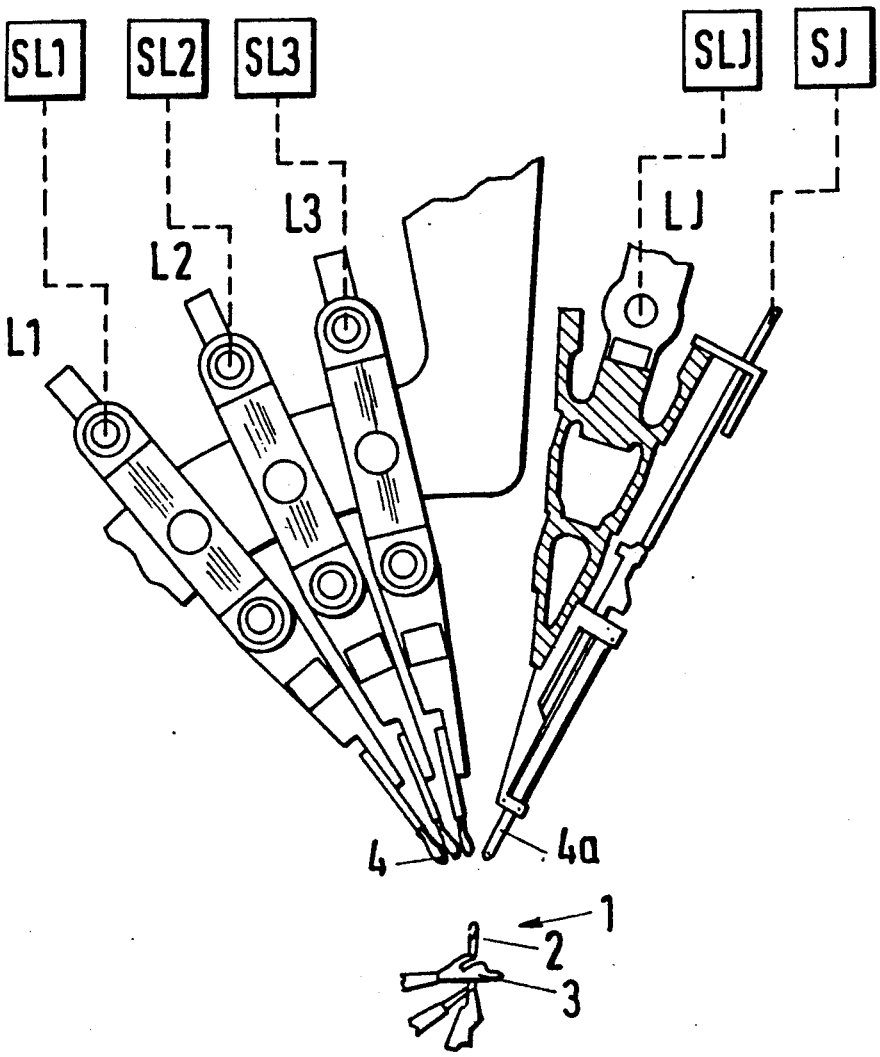
FIG. 1 is a schematic cross-sectional view of the working area of a warp knitting machine.

FIG. 1 shows the operating portion of a warp knitting machine. There is illustrated a needle bed 1 provided with slider needles 2 and tricot sinkers 3. There are provided four guides bars designated L1, L2, L3 and Lj which carry guides 4 and with respect to the last **4*a* (which are jacquard guides). The guide bars L2 and L3 are utilized for the formation of the ground ware, guide bar L1 produces the pile loops on the rear side of the goods and guide bar Lj** the pile loops on the front side.

Each guide bar is provided with its appropriate control mechanism SL1, SL2, SL3 and SLj, which provide the appropriate guide bars with the desired basic lapping motion (perpendicular to the plane of the paper in FIG. 1), so that the threads lead from guides 4 and **4*a* are lapped about the appropriate needles 2**.

Figure 2:
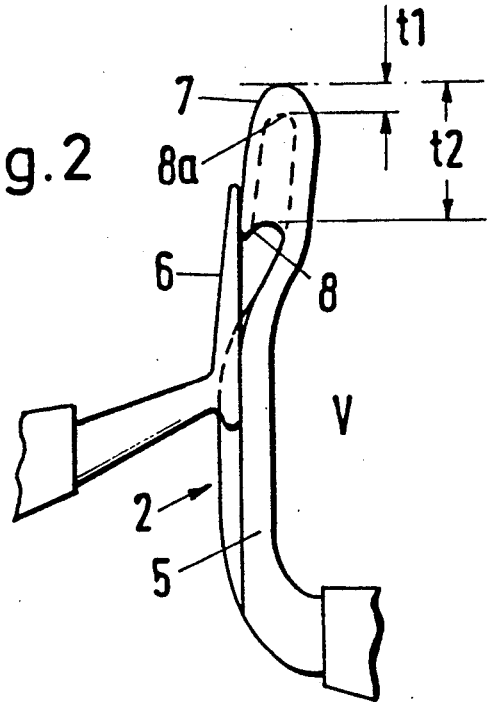
FIG. 2 is a side elevation view of full head needle.

The needles 2 are provided in the form of hook needles 5 equipped with a corresponding slider 6. As will be seen from FIGS. 3 through 7 the first needles N and the second needles V alternate with each other. THe first needles N are normal needles, the second needles V are full head needles of the type illustrated in FIG. 2. In such needles the head 7 of the hook is thickened. The base 8 of the thread space is displaced with respect to the ground **8*a* of a normal first needle N (shown in phantom) so that the knockover position shown in FIG. 2** yields the greater knockover depth t2 than the normal knockover depth t1. This permits the formation of larger pile loops with the full head needle then would be possible with the normal needle.

Figure 3:
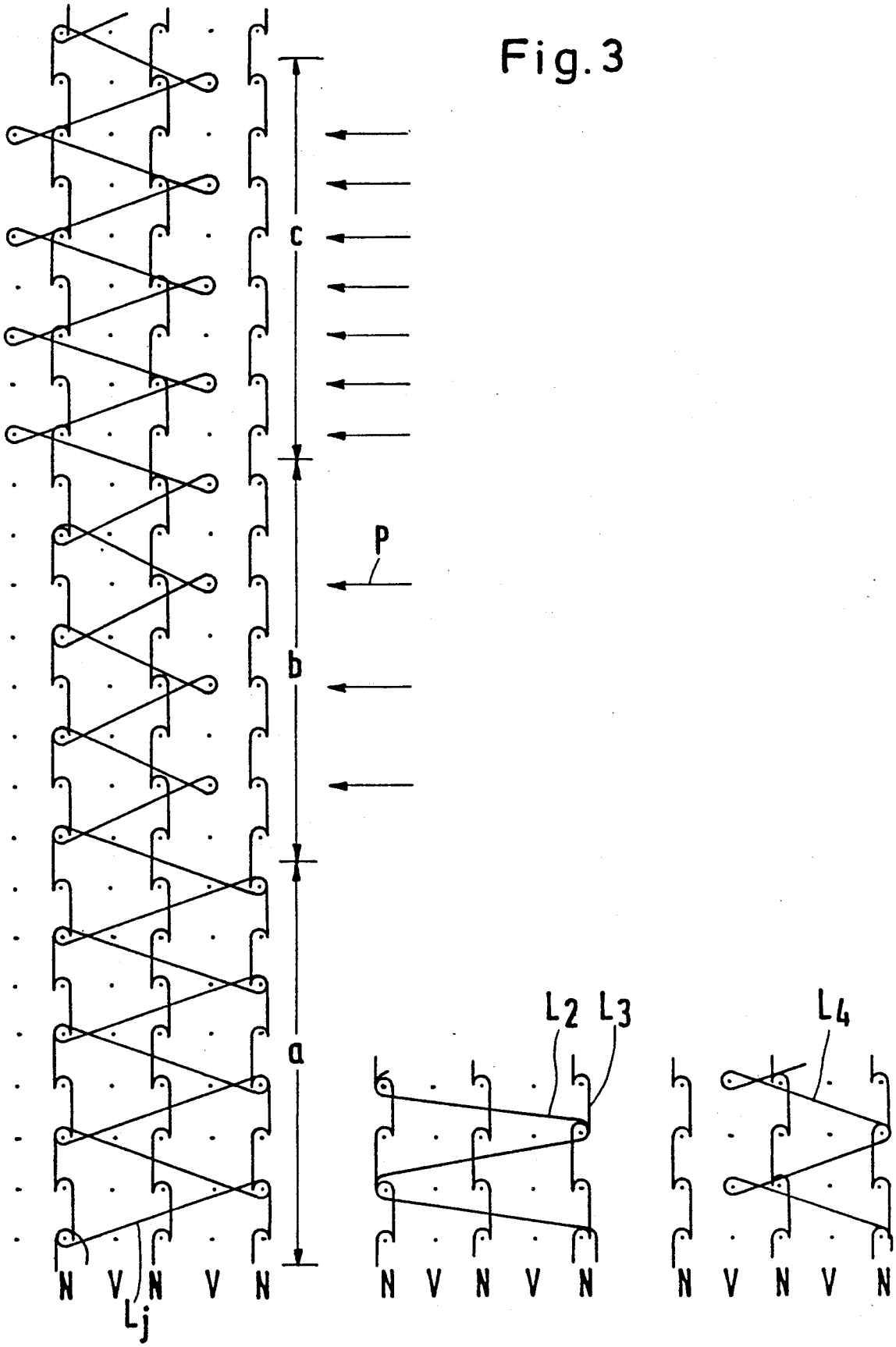
FIG. 3 is a lapping diagram for a first embodiment in expanded format.
Figure 4:
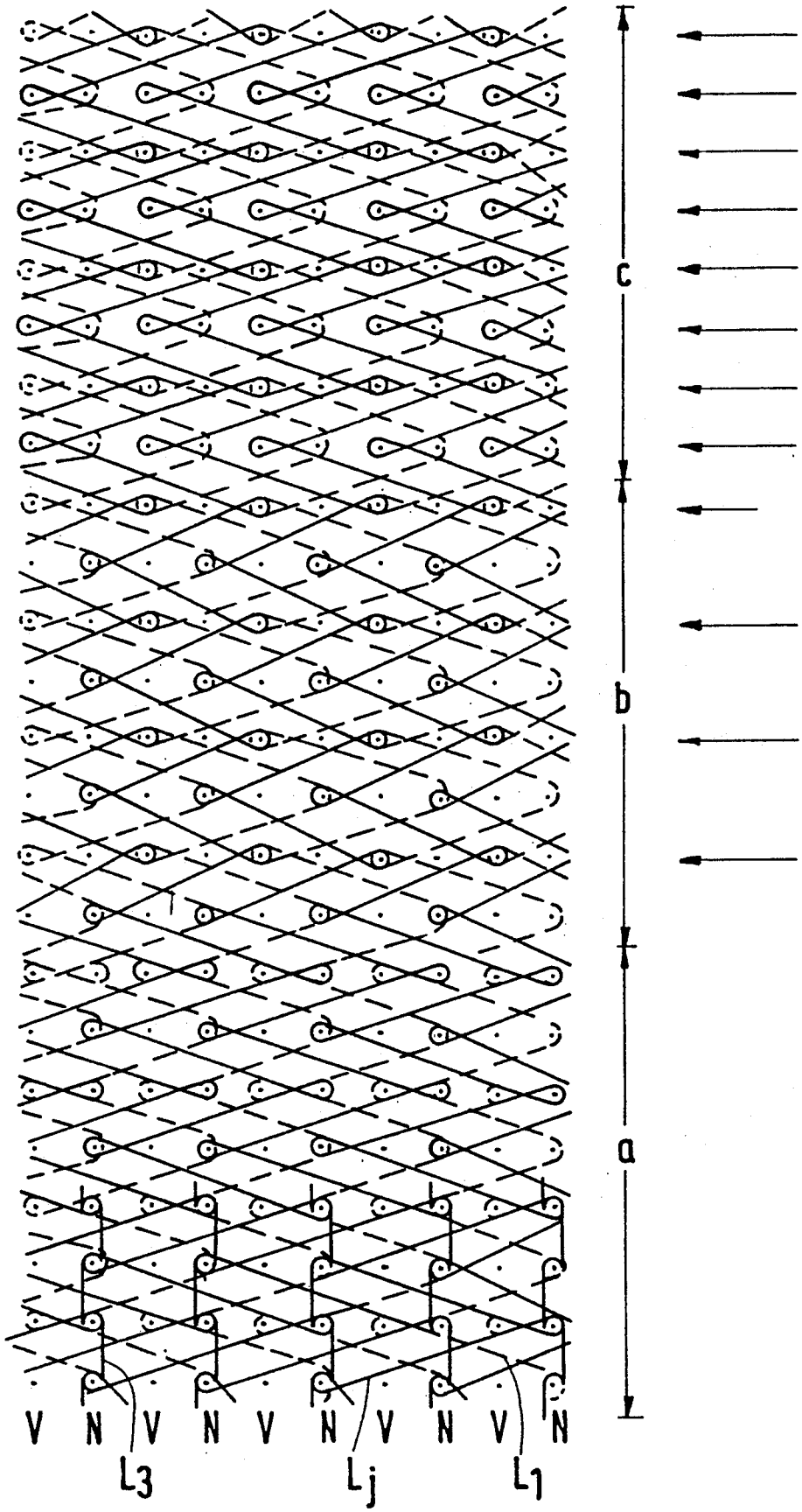
FIG. 4 is a lapping diagram of FIG. 3, wherein both pile thread systems are shown laid over each over.

In the embodiment of FIGS. 3 and 4, chain stitches are laid around first needles N by means of guide bar L3 and partial weft inserts by guide bar L2, so that a structured ground ware is provided. The rearward pile thread guide bar L1 gives rise to a lapping wherein the pile threads are alternately laid about first needles N and second needles V. A weft lap is provided around the first needles N which is tied off by means of guide bar L3. On second needles V, a loop is formed. Since the second needles V are only lapped during each second work cycle, the thread loops found on these needles would be knocked off as pile loops. Guide bar L3 is threaded on every other guide to provide stitching on the N needles but not the V needles, as shown in FIGS. 3 and 4. Guides of bar L2 may be similarly threaded. Guide bars L1 and Lj are threaded on every other guide to provide the knotting or loops on the N and V needles, as shown in FIGS. 3 and 4. The initial lapping movements are: bar L1 is 0-0/3-4; bar L2 is 0-0/5-5; bar L3 is 1-0/0-1; and bar Lj is 4-5/1-0. The changes in lapping motions for bars L1 and Lj are illustrated as well.

Three areas are illustrated for the provision of pile threads by means of jacquard bar Lj. Area "a" comprises the opening lap in which the jacquard guides **4*a* are not suppressed. The pile threads are alternately laid about two first needles N and there stitched in on the forward side of the goods therefore, no pile loops are created. In area "b", in every second work cycle the jacquard guides are pressed to the left as indicated by arrow P. This causes the pile threads to lie alternately about a first work needle N and a second needle V upon which the pile loops are formed. In area "c", the jacquard needles 4*a* are pressed to the left in every work cycle (compare arrows) thus, the pile threads are alternately laid around two second needles V. This however, always occurs alternating with the lapping of the pile thread of bar L1**, which gives rise to stitch formation and hence, goods which are smooth on both sides.

In area "a", the rearward side of the goods is thus provided with pile loops whereas, the forward side is not. In area "b" both sides carry pile loops. In area "c", both sides are pile free. In FIG. 4, for reasons of better comprehension, there is illustrated in similar displacement of the whole forward pile thread system. In practice however, it is possible to displace each thread to the left or to the right at will in order to achieve the desired patterning.

Figure 5:
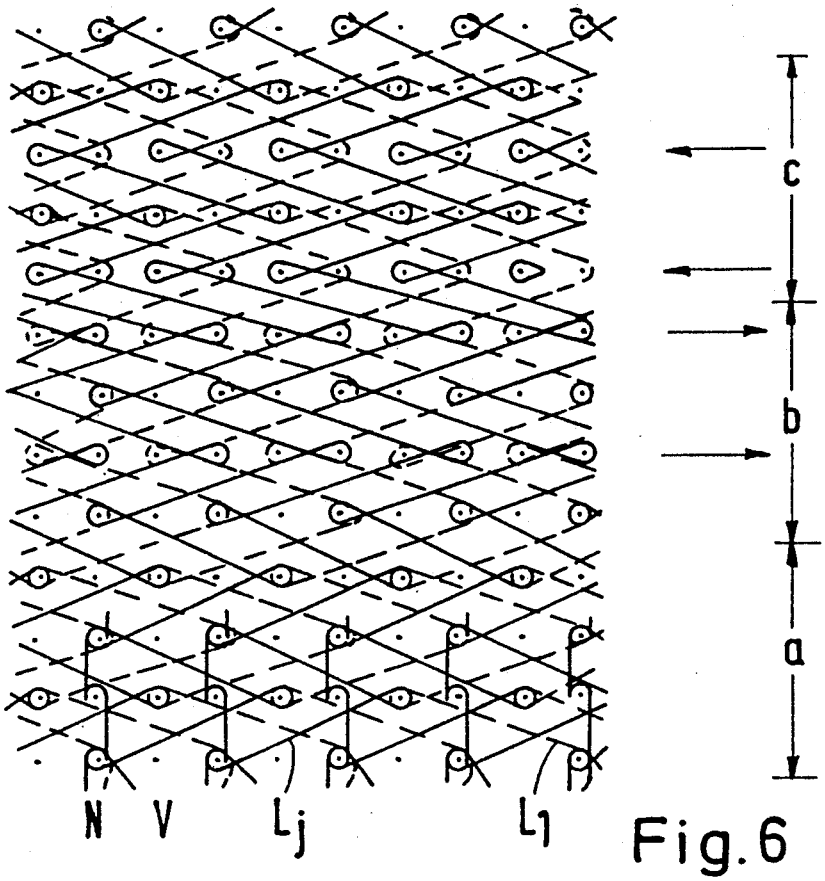
FIG. 5 is a lapping diagram of a second embodiment.
Figure 6:
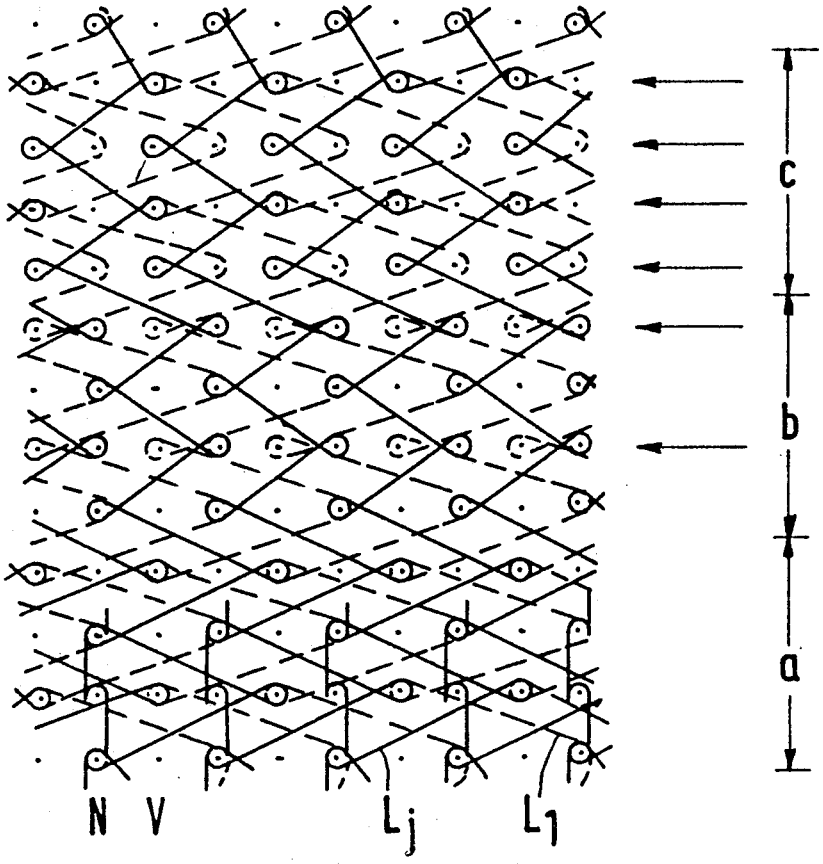
FIG. 6 is a lapping diagram of a third embodiment.

FIGS. 5 and 6, correspond to the lapping with the guide bars L1, L2 and L3 in the previously described lapping motion. The opening lap of the forward pile threads however, is different. Here, utilizing jacquard guides **4*a* which are not displaced, the pile threads are alternately laid about a first needle N and a second needle V, this means that the goods are provided with loops on both sides. In segment "b", the forward pile threads are displaced to the right in each second working cycle in FIG. 5, and to the left in each second working cycle of FIG. 6. Thus, in each case there are obtained pile loops only on the rearward side of the goods. In area "c" of FIG. 5, a displacement of the jacquard needles 4A occurs to the left in the first of two working cycles; in FIG. 6**, however, in each working cycle. In both cases, there are provided goods which are smooth on each side.

Figure 7:
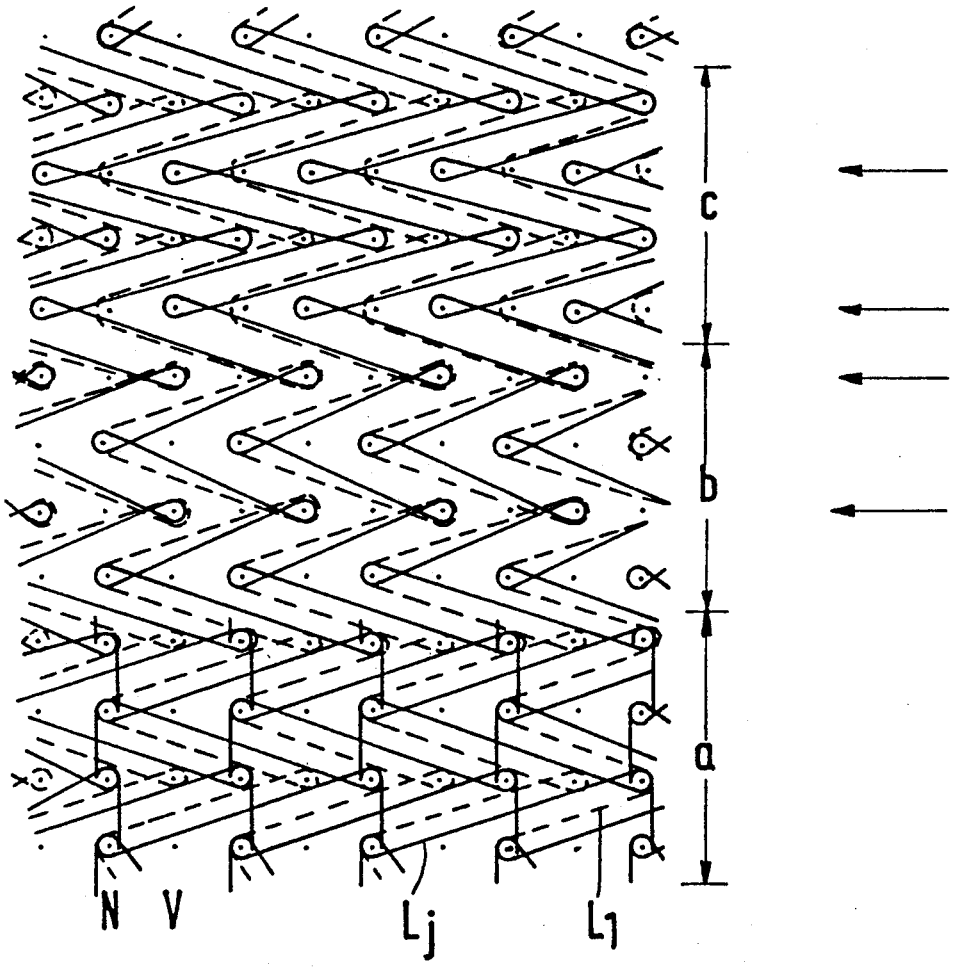
FIG. 7 is a lapping diagram of a fourth embodiment.

The lapping shown in FIG. 7 the opening lap in area "a" is of the same type for jacquard guide bar Lj, as shown in FIGS. 3 and 4. In contrast thereto, the lapping of pile thread guide bar L1 is equivalent to the lapping of jacquard guide bar Lj. This results in the goods having loops on the rearward side. In area "b", the jacquard guides 4a are pressed to the left in each second cycle. This gives rise to areas carrying pile loops on both sides. In area "c", one cycle later, the jacquard guides 4a are again pressed to the left in the first of every two work cycles, this gives rise to goods which are smooth on both sides. In FIGS. 5, 6 and 7 the threading of the guides for the ground ware may be the same as that shown in FIGS. 3 and 4. Guide bars L1 and Lj are threaded on every other guide to provide the knotting or loops on the N and V needles, as shown in FIGS. 5, 6, and 7. The initial lapping movements in FIGS. 5 and 6 are: bar L1 is 0-0/3-4; and bar Lj is 3-4/1-0. The changes in lapping motions for bars L1 and Lj are illustrated in FIGS. 5 and 6 as well. Bars L2 and L3 may move the same as in FIGS. 3 and 4. The initial lapping movements in FIG. 7 are: bar L1 is 4-4/1-0; and bar Lj is 4-5/1-0. The changes in lapping motions for bars L1 and Lj are illustrated in FIG. 7 as well.

Many variations of the principals set forth hereinabove, can be carried out by one skilled in the are without departing from the basic idea of the invention. For example, it is possible to operate the system utilizing needles of equal size throughout. The first and the second needles do not have to alternate with each other. It is also possible to provide more than one second needle between each first needle. That is to say, between two second needles there may be provided more than one first needle. This process and construction may also be utilized on Raschel machines.

We claim:

1. Process for the preparation of warp knitting goods with pile loops upon a warp knitting machine comprising a needle bed having a plurality of primary needles and a plurality of secondary needles, and a group of thread systems including a groundware thread system controlled by a groundware guide bar, and dual pile thread systems including a front pile thread system for the front of the goods controlled by a forward guide bar, and a rearward pile thread system for the rear of the goods controlled by a rearward guide bar, the process comprising the steps of:

forming the ground ware by lapping about at least two of said primary needles with at least one of said group of thread systems and forming stitches thereon, lapping threads of said forward and rearward pile thread systems, alternately (a) around at least one of said primary needles, and, (b) in a following work cycle, around at least one of said secondary needles not involved in the formation of the ground ware to subsequently form upon knock-over pile loops on the forward and rearward side of the goods, and forming pile free locations by providing that at least one of the threads of at least one of the dual pile thread systems is individually controlled to enable laying over a selected one of either said primary or said secondary needles in accordance with a predetermined pattern.

2. Process in accordance with claim 1, wherein at least a predetermined one of said pile threads from said dual pile thread systems is laid alternately over a corresponding pair of said primary needles.

3. Process in accordance with claim 1, wherein the individual pile threads are laid alternately about two of said secondary needles in such a manner that said respective ones of said secondary needles have alternately laid about them threads from said forward and said rearward pile thread systems.

4. Process in accordance with claim 1, wherein only the threads of the forward pile thread system are individually steerable to meet the requirements of the pattern.

5. Process in accordance with claim 1, wherein the size of the laps of the threads of the forward thread pile system is so arranged that the thread consumption of the pile free and pile containing areas of the goods produced are substantially similar.

6. Warp knitting machine for carrying out the process of manufacturing piled goods comprising:

a needle bar having two interdigitated pluralities of primary and secondary needles, at least one ground ware guide bar, and a pair of pile guides including a forward and a rearward pile thread guide bar, and a guide bar control arrangement for the provision of a basic lap, wherein at least one of said pair of pile guides includes:

a jacquard bar whose guides are individually displaceable, and a jacquard control arrangement arranged for laying in an unaltered base lap of the jacquard bar the appropriate pile thread, upon choice, over one of either said primary or said secondary needles.

7. Warp knitting machine in accordance with claim 6, wherein only the forward pile thread guide bar is equipped as a jacquard bar.

8. Warp knitting machine in accordance with claim 6, wherein the jacquard control arrangement is equipped for base lapping wherein the appropriate pile threads can be alternately laid around the primary needles without displacement of the individual guides by said jacquard control arrangement.

9. Warp knitting machine in accordance with claim 6, wherein the secondary needles are provided in the form of full head needles having a shortened catching capacity.

* * * * *